United States Patent [19]

Davies

[11] Patent Number: 4,521,261

[45] Date of Patent: Jun. 4, 1985

[54] DOUBLE BASE PROPELLANT COMPOSITIONS

[75] Inventor: David G. Davies, Waltham Abbey, England

[73] Assignee: The Secretary of State for Defence in Her Britannic Majesty's Government of the United Kingdom of Great Britain and Northern Ireland, London, England

[21] Appl. No.: 638,856

[22] Filed: Aug. 8, 1984

[30] Foreign Application Priority Data

Aug. 12, 1983 [GB] United Kingdom ..... 8321754

[51] Int. Cl.[3] ..... C06B 25/34

[52] U.S. Cl. ..... 149/92; 149/19.8; 149/97; 149/98

[58] Field of Search ..... 149/92, 19.8, 97, 98

[56] References Cited

U.S. PATENT DOCUMENTS 4,099,376 7/1978 Japs ..... 149/19.92

4,386,978 6/1983 Baczuk et al. ..... 149/95

*Primary Examiner*—Stephen J. Lechert, Jr.

*Attorney, Agent, or Firm*—William R. Hinds

[57] ABSTRACT

A double base propellant composition having well-platonized ballistics at low burning rates consists of nitroglycerine (NG), nitrocellulose (NC) at least one lead compound and at least one copper (II) salt of an aliphatic dicarboxylic acid. The copper salt preferably comprises copper succinate, and the lead compound may include any of those known as ballistic modifiers in the propellants art. A preferred composition, having a platonized burning rate of 2.3 mm $s^{-1}$ at a chamber pressure of 2–3 MPa, comprises by weight 35.1% NC (12.6% nitrogen), 41.6% NG, 8.3% triacetin, 10.7% sucrose octa-acetate, 0.3% 2-nitrodiphenylamine, 1.2% p-nitromethylaniline, 1.0% copper (II) succinate and 1.8% lead acetophthalate.

18 Claims, 10 Drawing Figures

DOUBLE BASE PROPELLANT COMPOSITIONS

Figure 1:
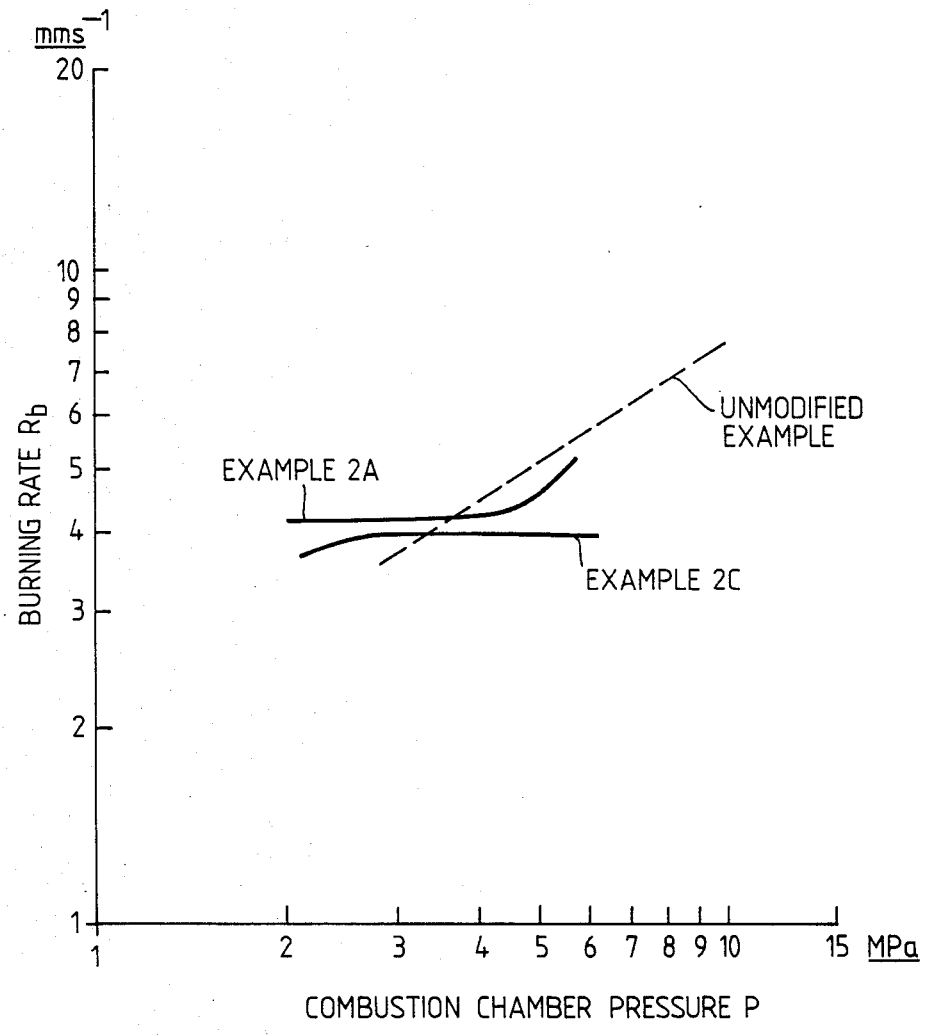

This invention relates to double-base propellant compositions containing ballistic modifiers for use in rocket motors, gas generators and the like, and to double base casting powders for use in the manufacture of these double base propellant compositions.

Double base propellant compositions are prepared using either casting or extrusion techniques. Cast double base propellant compositions are usually prepared by curing a mixture of nitrocellulose-nitroglycerine-containing casting powder and a nitroglycerine-containing casting liquid. It is known that the ballistic properties of solid propellants based on nitrocellulose (NC) and nitroglycerine (NG) prepared by either technique may be improved by the inclusion of ballistic modifiers. Without such modifiers, the burning rates of most double-base propellants are strongly dependet on the pressure and temperature in the combustion chamber, which under normal operating conditions gives rise to undesirable variations in performance. These modifiers are nearly always solid, and are usually introduced into cast double base propellant compositions via the casting powder because they are invariably insoluble in the casting liquid.

The pressure (P) dependence of buring rate ($R_b$) for a simple, unmodified propellant composition is described by the following equation I $$R_b = a^{P^n} \qquad \text{I}$$

where a and n are constants. From equation I it may therefore be seen that a logarithmic graphical representation of $R_b$ plotted against P for an unmodified composition gives a straight line of slope n. By including small quantities (typically less than 6% by weight) of a ballistic modifier, it is possible not only to enhance the burning rate over most of the range of operating pressures propellants are used over, but also to produce a region on the $R_b$ versus P logarithmic graph in which the slope is very small, zero, or even negative. The production of the region is known as platonisation. Such regions, where there is a low dependence of burning rate on pressure, are of great value where a modified composition is to be used in, for example, a rocket motor, and where the platonised region occurs over a desired working range of pressures for that motor.

A number of ballistic modifiers are known in the art which both enhance the burning rates of and produce platonisation in double base propellants. These modifiers usually comprise mixtures of inorganic and/or organic salts of transition metals, of which salts of lead are the most widely used. Typical examples of the more common modifiers are lead salicylate, lead $\beta$-resorcylate, and lead stearate. It is also known that further improvements in ballistic properties can be made using lead salt ballistic modifiers mixed with certain copper salts. Basic copper (II) salicylate has been used with various organic salts of lead to bring about improved platonisation at high burning rates (typically 25–40 mm $s^{-1}$) at high operation pressures in high energy double based propellants having calorimetric values generally in excess of 4200 kJ/kg. Modifiers used to promote plantonisation at low operating pressures have tended to be inorganic salts of transition metals. Copper (II) oxide has also been used in combination with lead salts as a ballistic modifier to enhance the width and shape of the platonised region for lower energy propellants, but only at burning rate below 25 mm $s^{-1}$.

One disadvantage of ballistic modifiers known in the art is that very few are capable of producing well developed platonisation in typical double base propellant compositions at low burning rates below about 4.5 mm $s^{-1}$, even at the lower end of the range of practical operating pressures for double base propellants (ie typically 2–2.5 MPa, below which pressure double base propellants tend to selfextinguish). Burning rate depressants such as sucrose octa-acetate or raffinose undeca-acetate may be used in the propellant compositions within certain limits to reduce burning rates in the platonised region, but if used much above a maximum of about 15% by weight in the propellant composition, they begin to have an adverse effect on the mechanical and other ballistic properties of the propellant. A further disadvantage of most known types of ballistic modifier used in propellant compositions prepared by casting techniques, is that their effect on the ballistic performance of these double base propellant compositions is highly dependent upon the method of composition manufacture.

It is an object of the present invention to provide a novel double-base propellant composition, whereby the above disadvantages are overcome or at least mitigated in part.

Other objects and and advantages of the present invention will become apparent from the following detailed description thereof.

Accordingly, there is provided a double base propellant composition comprising nitrocellulose, nitroglycerine and a ballistic modifier, said modifier comprising at least one lead compound and at least one copper salts of an aliphatic dicarboxylic acid. The copper salts described in this specification are copper (II) salts.

The copper salt of an aliphatic dicarboxylic acide may be any of those known in the organometallic art, but particularly advantageous effects on the ballistic properties of the present propellant compositions are found however when employing copper succinate. Ballistic modifiers comprising mixtures of the present copper salts, especially copper succinate, with any one of a number of lead compounds previously employed in the ballistic modifier art are found to produce consistently well developed platonisation in typical double base propellant compositions at useful combustion chamber pressures (generally between 2 and 15 MPa). At these useful chamber pressures, the present modifiers are found to be particularly effective in platonising double base compositions having Calorimetric Values below 5,000 kJ/kg, especially below 4,200 kJ/kg.

Preferably, the lead compounds which are advantageously mixed with the coppr salts (especially copper succinate) in the present ballistic modifier include lead (II) salts of inorganic acids such as basic lead carbonate and lead stannate, or lead (II) salts of organic acids such as lead citrate, lead phthalate, and lead acetophthalate. A significant advantage of using ballistic modifiers consisting of mixtures of copper succinate with any of these preferred lead compounds, is that they are capable of producing particularly well developed platonisation in low energy double based propellant compositions at very low burning rates of 2 to 5 mm $s^{-1}$. Platonisation at these very low burning rates has hitherto been impossible to achieve using ballistic modifiers, unless considerable modifications are also made to the basic constituents of the double base propellants. Such modifications give rise to undesirable effects on the mechanical properties of the propellants and to difficulties in their manufacture. A further advantage of the present invention is that, when fired in rocket motors, the present modified compositions are found to resist ballistic drift and to burn at a rate which is much less dependent on the temperature in the combustion chamber than unmodified compositions.

It has been found that satisfactory improvements in the ballistic properties of the present propellant compositions are produced when the composition contains from 0.2–3.0% by weight of the copper (II) salt, and a total of 0.5–10% by weight, preferably 1–6% by weight, of the ballistic modifier. Above a ballistic modifier content of about 6%, there is little further improvement in ballistic properties, and the displacement of other propellant constituents produces increasingly undesirable effects on other important properties of the composition. The weight ratio of the lead compounds to the copper salts in the ballistic modifier is preferably between 1:4 and 1:0.1. Optionally, the ballistic modifier may also contain small amounts of copper (II) oxide, in quantities up to 0.5% by weight of the propellant composition.

Platonisation of the ballistics of the present propellant composition at low burning rates is further enhanced by varying the content of the other propellant constituents. In particular, the addition of 0–20% by weight, preferably 0–15% by weight of rate depressants, such as raffinose undeca-acetate and especially sucrose octo-acetate, not only bring about a general reduction in the burning rate of the propellant composition over a range of combustion chamber pressures, but also tends to broaden the region of chamber pressures over which platonisation occurs. Other propellant additives such as nitroglycerine desensitisers, (eg triacetin) and stabilisers (eg 2-nitrodiphenylmethane and p-nitromethylaniline) generally have little effect on platonisation. The present inventor has also found that the present propellant composition may also contain up to about 30% by weight of a crystalline nitramine explosive filler, for example RDX, without having an unduly detrimental effect on the platonised ballistics of the composition.

A double base propellant composition in accordance with the present invention will therefore be understood by those skilled in the propellants art as consisting essentially of the following ingredients:

| | % by weight |
|---|---|
| Nitrocellulose | 25–60 |
| Nitroglycerine | 15–50 |
| Nitroglycerine Desensitiser | 5–15 |
| Nitramine | 0–30 |
| Stabiliser | 0.5–5 |
| Burning rate depressant | 0–20 |
| Ballistic modifier | 0.5–10 |

wherein the ballistic modifier comprises a mixture of one or more lead compounds and one or more copper salts of an aliphatic dicarboxylic acid, the ratio by weight of lead compounds to copper salts in said modifier being between 1:4 and 1:01, said propellant composition having platonised ballistics and a calorimetric value of less than 4,200 kJ/kg.

A further advantage of the double base propellant compositions of the present invention is that when prepared by various casting techniques, their ballistic properties appear little affected by the actual method of manufacture employed. The ballistic properties of cast double base propellants are notoriously sensitive to processing conditions employed during the manufacture of the casting powder. Indeed, the effect of the method of casting powder manufacture on ballistic properties is sometimes greater than the effect of the ballistic modifier itself. This can give rise to difficulties in formulating known propellant compositions, because as a result ballistic properties cannot always be accurately predicted. To overcome this problem, accurate and careful control must be exercised during manufacture to produce a propellant composition having reproducible ballistic properties. This exercise of control can be both time consuming and expensive. However, it has been found that when a propellant composition of the present invention is prepared from casting powders manufactured by a variety of known techniques, the variations in the ballistic properties of the composition prepared from each powder are very small, and generally well within limits which are acceptable for using the composition in rocket motors and the like.

A cast double base propellant composition in accordance with the present invention, containing nitrocellulose, nitroglycerine, a nitroglycerine desensitiser, a ballistic modifier, one or more stabiliser compounds, and optionally one or more rate depressants and/or a nitramine, is preferably manufactured by the conventional approach of first preparing a casting powder and a casting liquid from the propellant ingredients. The casting powder is conveniently prepared from all the above ingredients accepting about 60–80% of the nitroglycerine, some or all of the one or more stabilisers, and all of the nitroglycerine de-sensitiser. Hence, the casting powder preferably contains 0.3–4.5% by weight copper salt and 1.5–9% by weight ballistic modifier. The powder ingredients are first mixed with a first solvent until fully wetted, then mixed with a second solvent to break down the nitrocellulose structure. The first solvent is conveniently an alcohol, and the second either diethyl ether or acetone. The ingredients thus treated are then powdered by fine extrusion followed by cutting and drying. The casting liquid is prepared by mixing the remainder of the ingredients. The propellant composition is conveniently made up into moulds to a desired propellant charge design, by introducing the liquid into contact with the powder within the mould and then curing the powder and liquid in situ over a prolonged period of time at an elevated temperature (typically 45°–60° C.).

Figure 2:
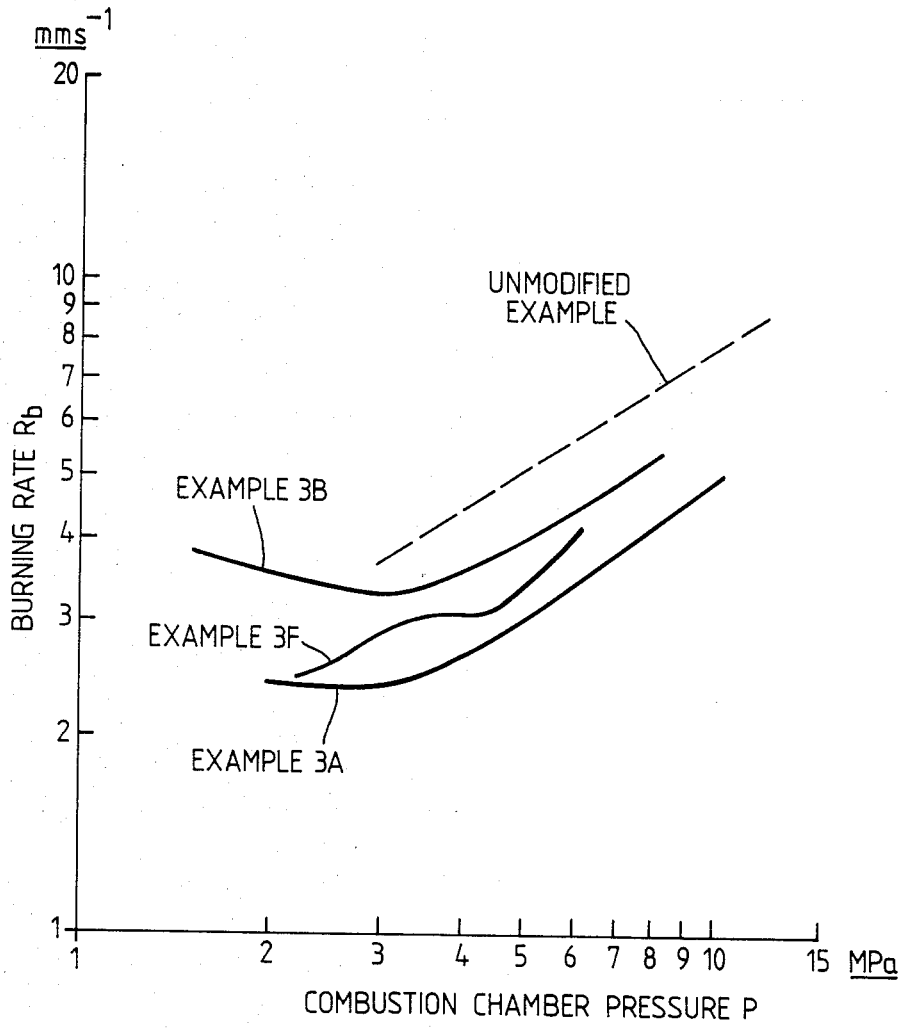
Figure 3:
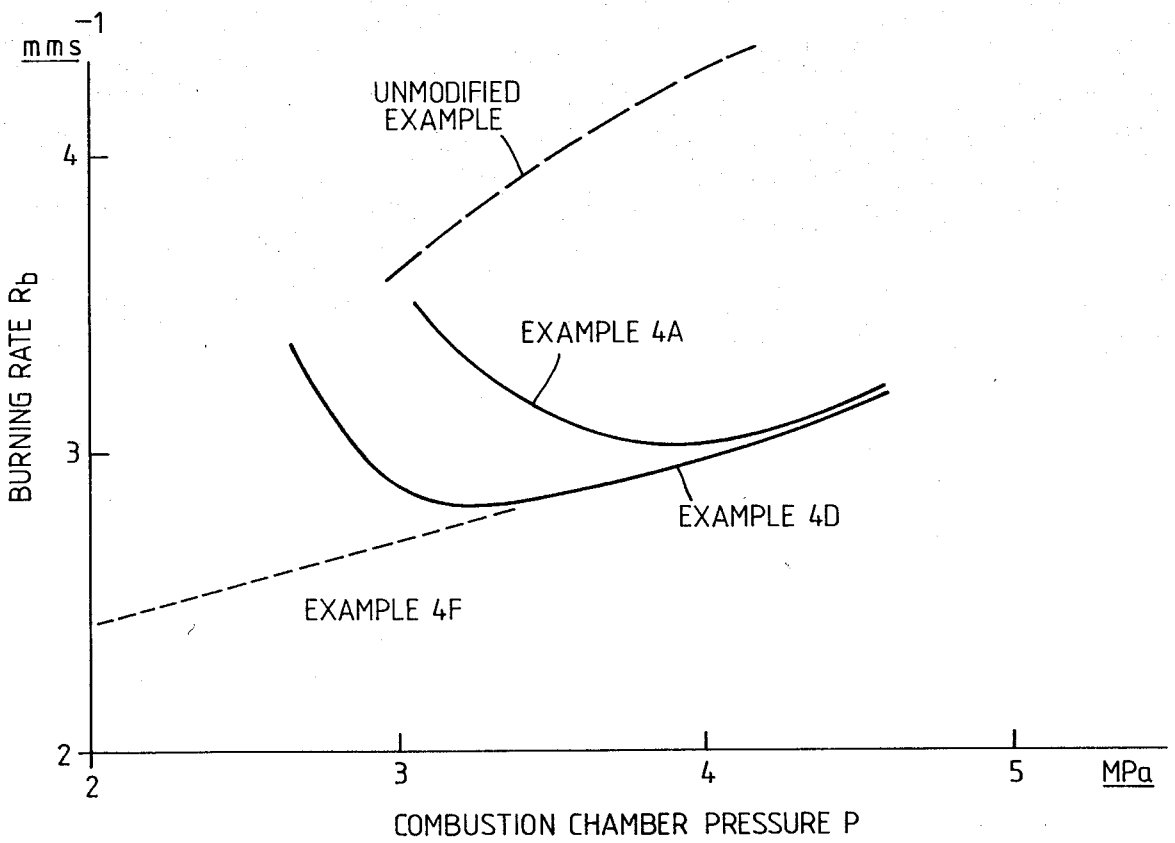
Figure 4:
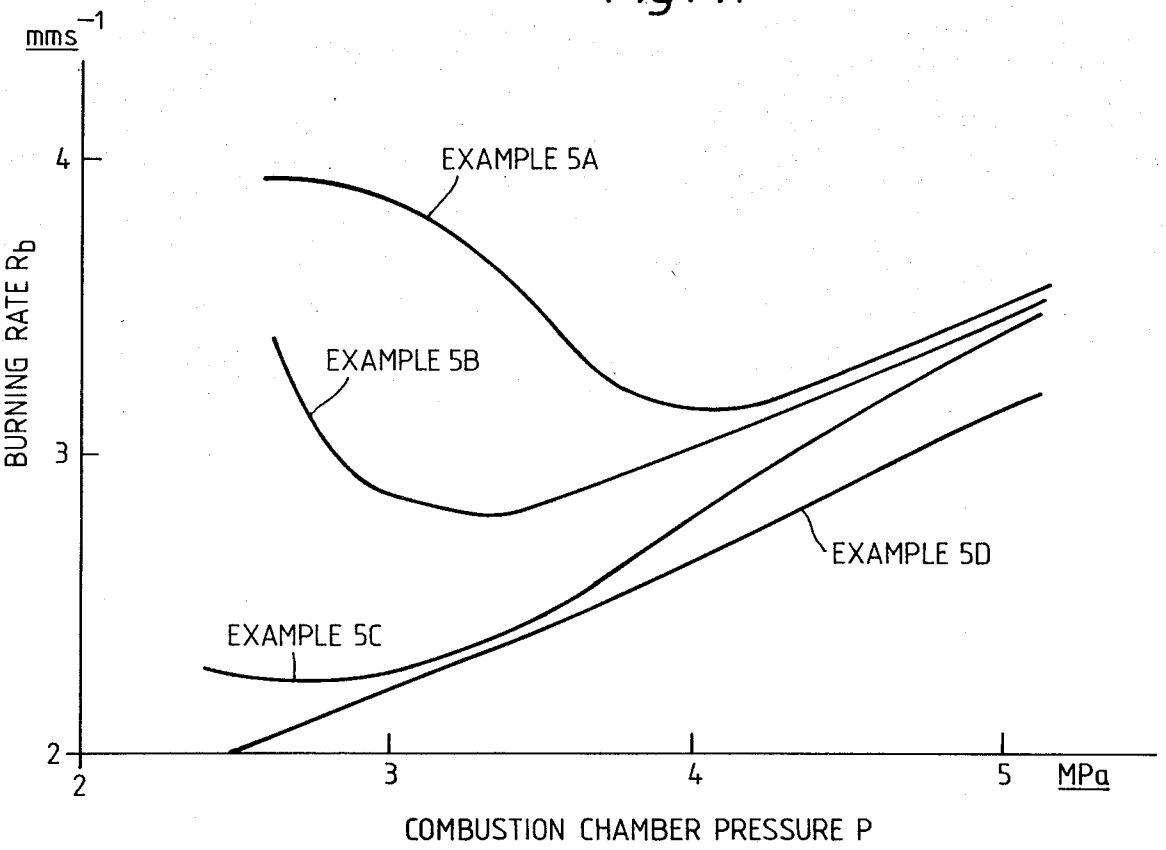
Figure 5:
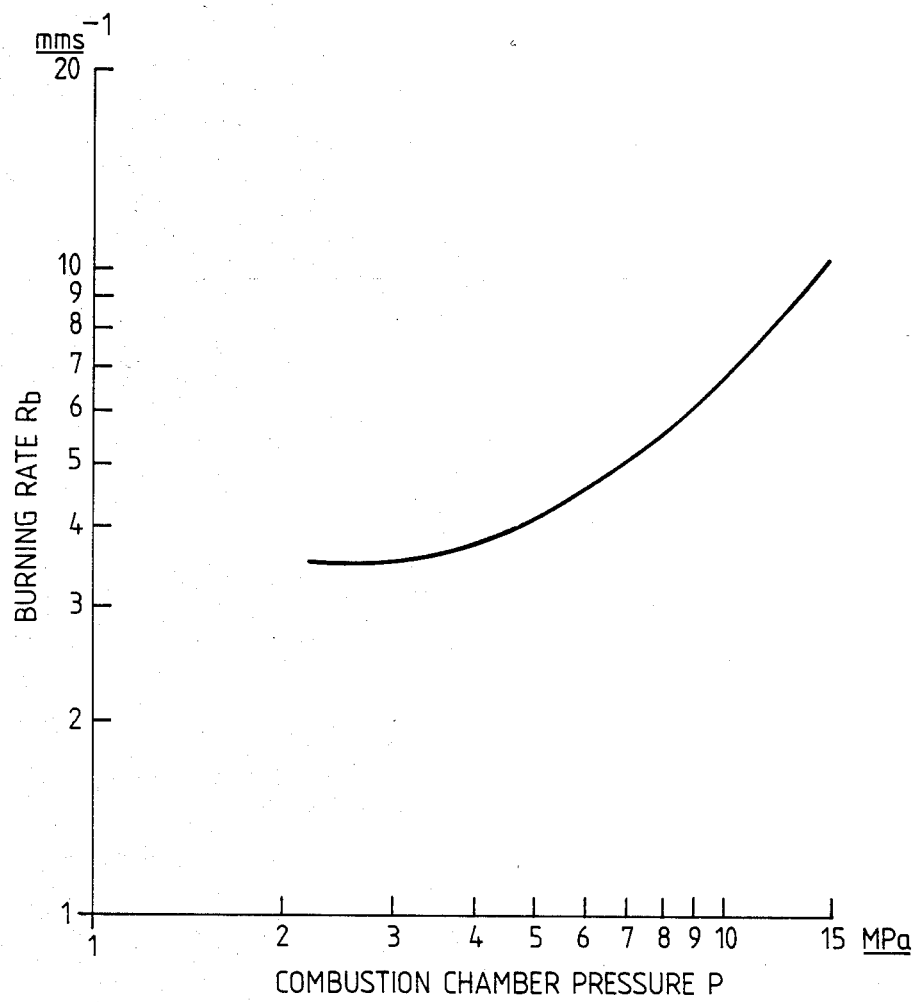
Figure 6:
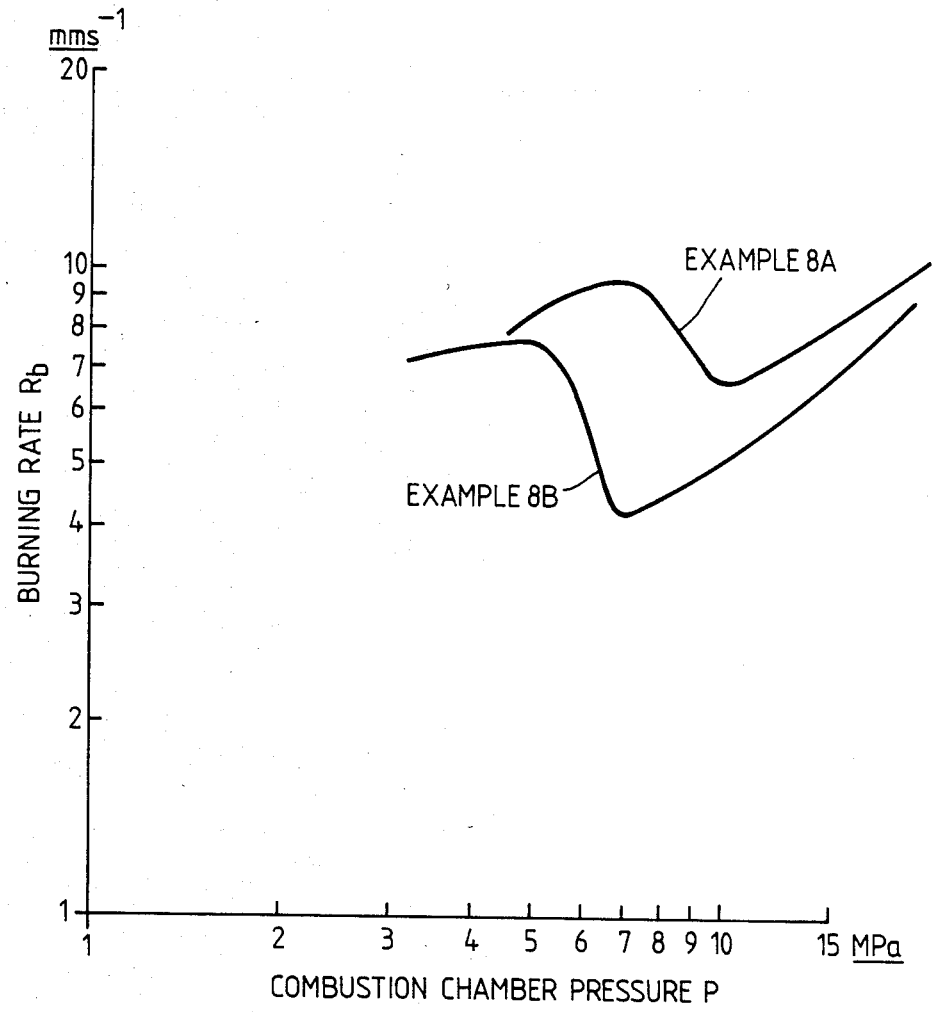
Figure 7:
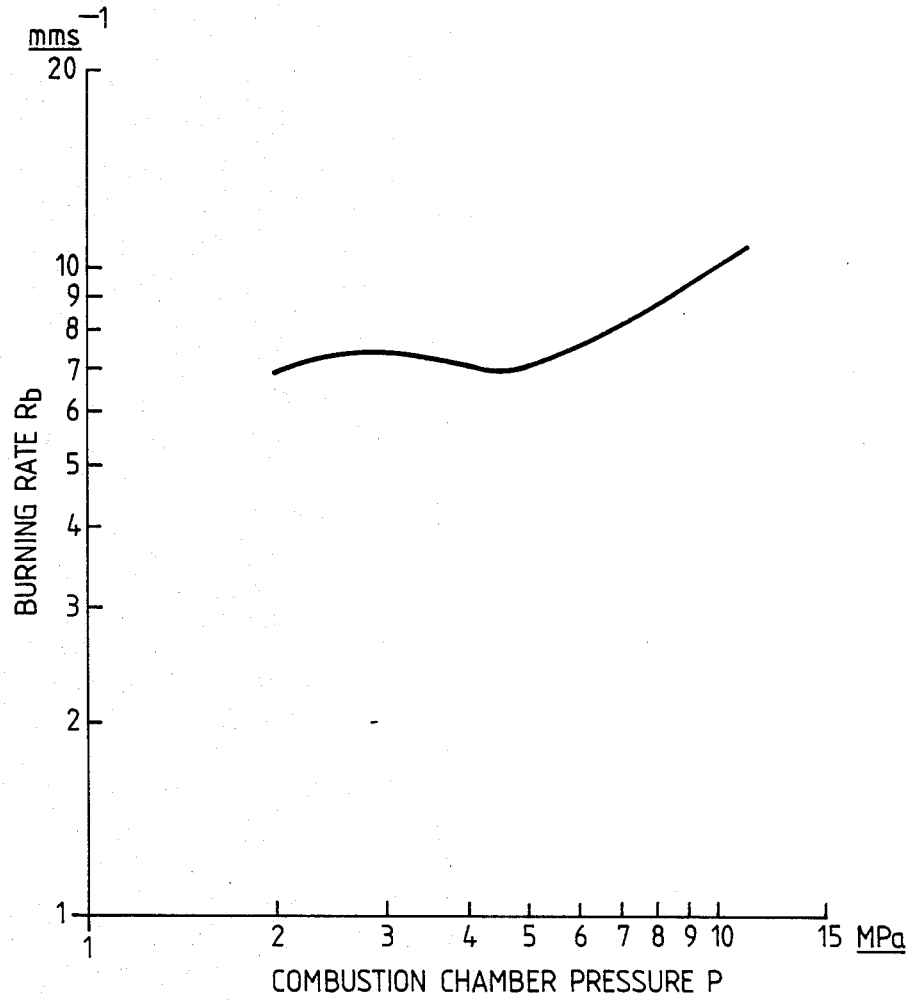
Figure 8:
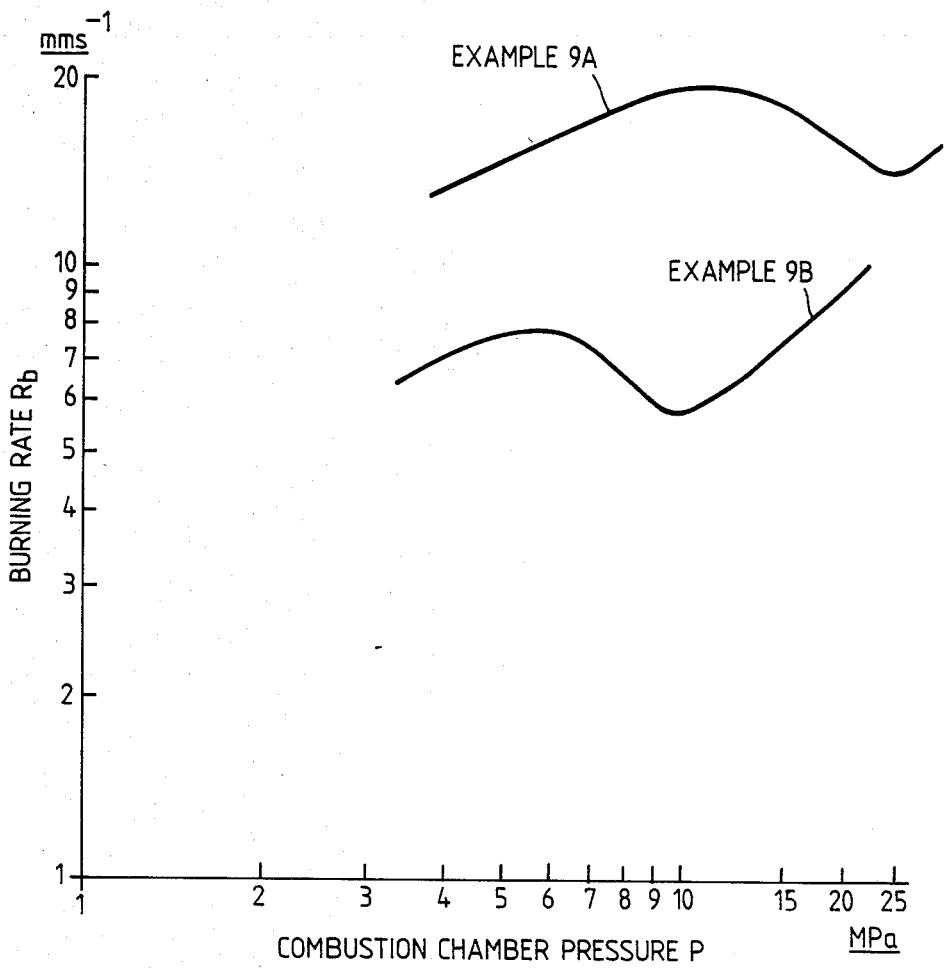
Figure 9:
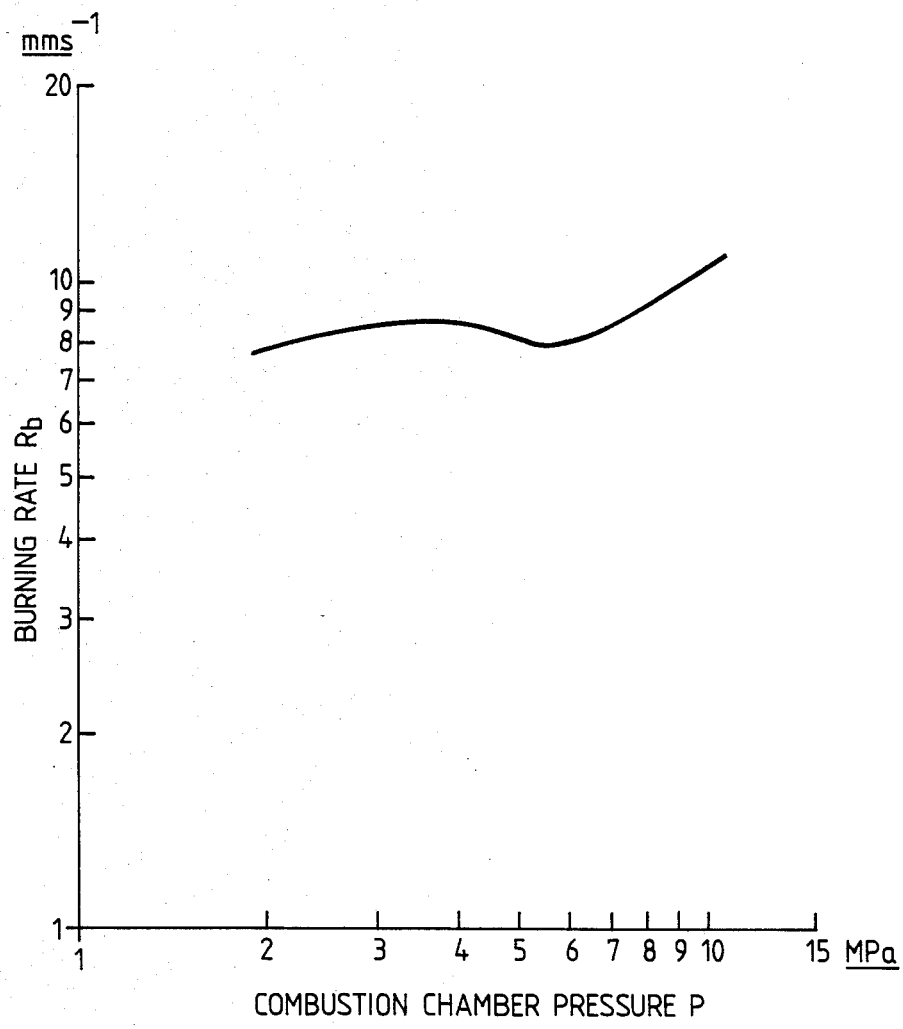
Figure 10:
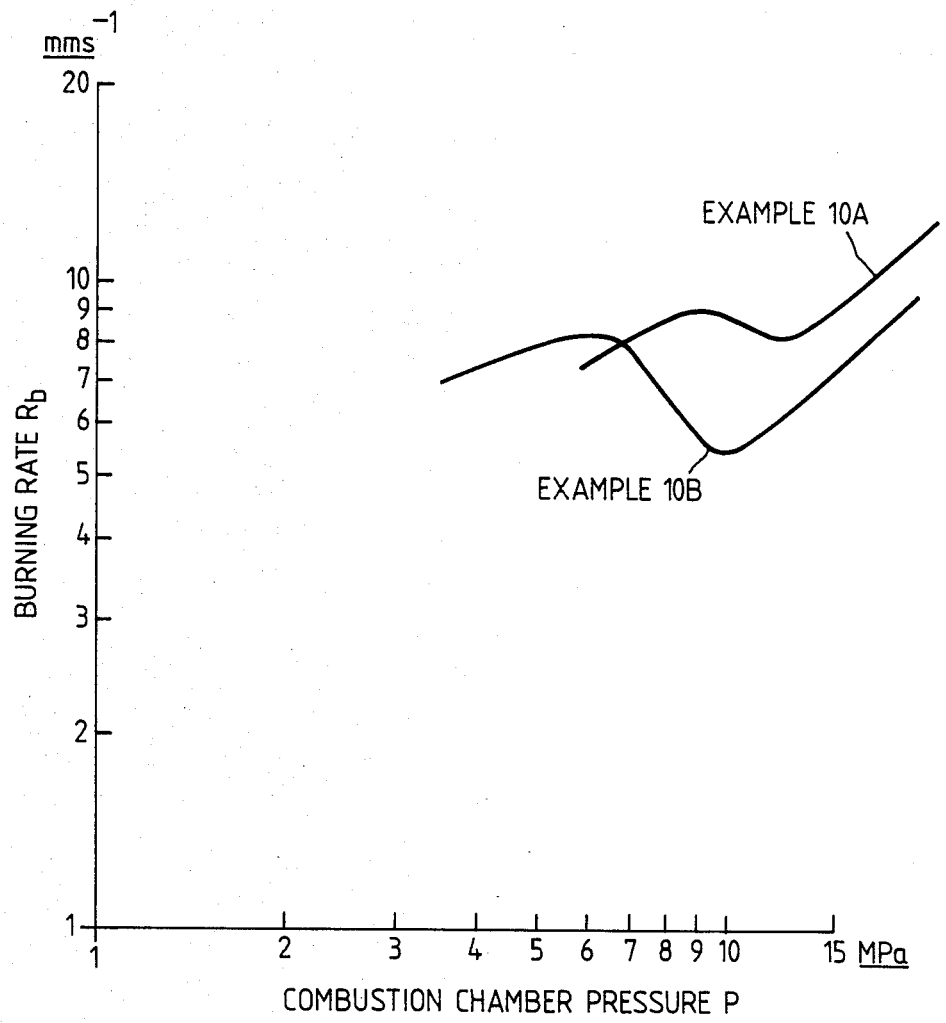

The preparation and properties of double base propellant compositions according to the present invention, and the preparation of casting powders for the manufacture of these propellant compositions, will now be described by way of Example only with reference to the accompanying drawings of which FIG. 1 is a natural logarithmic graphical illustration of the relationship between burning rate ($R_b$) and combustion chamber pressure (P) observed during the combustion of cast double-base propellant compositions containing copper succinate and basic lead carbonate, FIG. 2 is a natural logarithmic illustration of the relationship between $R_b$ and P for propellant compositions containing copper succinate and lead citrate, FIG. 3 is a linear graphical illustration of the relationship between $R_b$ and P observed during the combustion of double base propellant compositions containing copper succinate and lead acetophthalate, FIG. 4 is a linear graphical illustration of the relationship between $R_b$ and P for propellant compositions which contain copper succinate, lead acetophthalate and varying amounts of sucrose octa-acetate, FIG. 5 is a logarithmic graphical illustration of the relationship between $R_b$ and P for a propellant composition containing copper succinate, lead acetophthalate, and the nitramine RDX, FIGS. 6 and 7 are logarithmic graphical illustrations of the relationship between $R_b$ and P for extruded double base propellant compositions containing copper succinate and various lead compounds, FIGS. 8 and 9 are logarithmic graphical illustrations of the relationship between $R_b$ and P for extruded propellant compositions containing copper oxalate and various lead compounds, and FIG. 10 is a logarithmic graphical illustration of the relationship between $R_b$ and P for extruded propellant compositions containing copper tartrate and two lead compounds.

EXAMPLE 1 (COMPARATIVE EXAMPLE)

A double-base propellant composition containing a ballistic modifier consisting of copper succinate alone was prepared from the following constituents.

| Constituent | % by weight |
|---|---|
| nitrocellulose NC (12.6% nitrogen N) | 52.4 |
| nitroglycerine NG | 30.3 |
| triacetin TA | 7.3 |
| raffinose undeca-acetate RUA | 6.2 |
| 2-nitrodiphenylamine 2-NDPA | 0.3 |
| p-nitromethylaniline p-NMA | 0.8 |
| copper succinate | 2.7 |

The composition of Example 1 was prepared by a conventional casting technique known in the art of double base propellant manufacture. A casting powder was first prepared from the above constituents with the exception of all the triacetin, about 70% of the nitroglycerine and about 50% of the 2-NDPA. The powder constituents were first blended with ethanol for one hour in a premix stage at room temperature. A quantity of diethyl ether was then added, and mixing was continued for a further three hours in a postmix stage to produce an homogeneous, doughy mass. During the postmix stage, the ether/ethanol mixture acts as a gellating solvent which slowly breaks down the nitrocellulose content of the mass. The mass was then hydraulically pressed and extruded into a 1 mm diameter cord extrudate. This extrudate was cut into 1 mm lengths and dried to a powder for 12 to 15 hours in warm air at 45°–60° C. The casting powder so produced was then packed into a mould, and a casting liquid, consisting of the triacetin and the remainder of the nitrocellulose and the 2-NDPA, was pumped slowly into the base of the mould. The quantity of liquid added was found sufficient to fill the interstices. The contents of the mould were then heated to 45°–60° C. for 4–6 days to produce a cured charge of the propellant composition of Example 1 ready for a firing test in a rocket motor. A number of charges were prepared by the above method, so that the ballistic properties of the composition of Example 1 could be determined at a number of combustion chamber pressures.

The Calorimetric Value (CV) of the above composition was 3810 kJ/kg, and over a combustion chamber pressure range of 2 to 15 MPa, the calculated pressure exponent (ie the value of n in equation 1 above) always exceeded a minimum of 0.5. Clearly, platonisation had not occurred over the pressure range examined. A series of propellant compositions containing copper succinate alone as a ballistic modifier were then prepared, each differing from that of Example 1 in NG and NC content, and in CV. However, in none of these further compositions was platonisation observed to occur, and the ballistic properties of these further compositions were found virtually identical to corresponding unmodified propellant compositions (ie compositions not containing ballistic modifiers but otherwise having identical CV's).

EXAMPLE 2

Five double-base propellant compositions (labelled Examples 2A through 2E inclusive) each containing a ballistic modifier consisting of a mixture of copper succinate and basic lead carbonate (white lead), were prepared from the following constituents listed in Table 1 below.

TABLE 1

| | % by weight | | | | |
|---|---|---|---|---|---|
| Constiuent | Ex 2A | Ex 2B | Ex 2C | Ex 2D | Ex 2E |
| NC (12.6% N) | 58.8 | 57.2 | 57.2 | 59.8 | 57.1 |
| NG | 23.3 | 21.3 | 20.6 | 23.4 | 25.1 |
| TA | 7.4 | 11.1 | 8.5 | 7.1 | 7.8 |
| SOA* | 5.0 | 4.9 | 8.2 | 5.1 | 4.9 |
| 2-NDPA | 0.3 | 0.3 | 0.3 | 0.3 | 0.3 |
| p-NMA | 1.2 | 1.2 | 1.2 | 1.2 | 1.2 |
| Copper succinate | 2.0 | 2.0 | 2.0 | 1.0 | 1.7 |
| White lead | 2.0 | 2.0 | 2.0 | 2.1 | 1.3 |

*sucrose octa-acetate

The CV's of each of the above composition Examples 2A to 2E inclusive were respectively 3350 kJ/kg, 2910 kJ/kg, 2840 kJ/kg, 3390 kJ/kg and 3370 kJ/kg. Each of the compositions was prepared from a solid powder and a liquid component by the same method of preparation as used in Example 1. An unmodified composition of identical CV to that of Example 2A was also prepared by the same method. Cured changes of each of the compositions were tested in an identical manner to that described in Example 1, in order to determine the relationship between burning rates and combustion chamber pressures. FIG. 1 illustrates a logarithmic graphical representation of the results of these tests conducted on Examples 2A, 2C, and on the unmodified composition.

As may be seen from FIG. 1, Examples 2A and 2C both produced well developed platonisation effects at burning rates of 4.0 and 4.2 mm $s^{-1}$ respectively over wide ranges of combustion chamber pressures within a useful combustion chamber pressure range of 2 to 10 MPa. Examples 2B, 2D and 2E (results not illustrated in FIG. 1) also produced well developed platonisation effects over similar pressure ranges at burning rates between 4.3 and 5.1 mm $s^{-1}$. Mixtures of copper succinate and white lead are therefore shown to be particularly effective ballistic modifiers for double base propellants, producing platonisation in a range of propellant compositions. The ballistics appear to be relatively insensitive to the total level of and ratio of white lead and copper succinate: as the ratio changed from 1:2 to 1.3:1 copper salt: lead salt, the plateau burning level remained relatively constant at 4 to 5 mm $s^{-1}$.

EXAMPLE 3

Six double-base propellant compositions (labelled Examples 3A through 3F inclusive), each containing a ballistic modifier consisting of a mixture of copper succinate, lead(II)citrate, and optionally copper (II) oxide, were prepared from the following constituents listed in Table 2 below.

TABLE 2

| | % by weight | | | | | |
|---|---|---|---|---|---|---|
| Constituent | Ex 3A | Ex 3B | Ex 3C | Ex 3D | Ex 3E | Ex 3F |
| NC (12.6% N) | 47.5 | 39.6 | 42.5 | 41.6 | 42.3 | 49.0 |
| NG | 33.4 | 42.3 | 42.4 | 43.6 | 46.1 | 31.7 |
| TA | 8.35 | 8.1 | 7.6 | 10.4 | 7.1 | 7.8 |
| SOA | — | 5.6 | 2.9 | — | — | — |
| RUA | 5.5 | — | — | — | — | 5.7 |
| 2-NDPA | 0.35 | 0.3 | 0.3 | 0.3 | 0.3 | 0.3 |
| p-NMA | 0.75 | 0.7 | 0.7 | 0.7 | 0.7 | 0.8 |
| Copper succinate | 2.55 | 1.7 | 1.8 | 1.7 | 1.8 | 2.6 |
| lead citrate | 1.6 | 1.7 | 1.8 | 1.7 | 1.8 | 1.7 |
| copper oxide | — | — | — | — | — | 0.4 |

The CV's of each of the above compositions Example 3A to 3E inclusive were respectively 3780 kJ/kg, 3900 kJ/kg, 4170 kJ/kg, 4220 kJ/kg and 4600 kJ/kg. The CV of Example 3F was not measured, but was known to be very similar to that of Example 3A. Each of these compositions and a further unmodified composition of identical CV to Example 3A were prepared in the same way as Example 1, and cured changes of all the compositions were subjected to ballistic tests, in order to determine the relationship between burning rate and combustion chamber pressure for each. The results of ballistic tests conducted on Examples 3A, 3B, 3F and the unmodified Example are illustrated by logarithmic graphical representation in FIG. 2.

From the representation of FIG. 2, it may be seen that well developed platonisation was produced in Examples 3A, 3B and 3F, up to a combustion chamber pressure of 4 MPa. Very similar ballistic behaviour was exhibited by Examples 3C and 3D, but in Example 3E platonisation had deteriorated to a low slope plateau. Examples 3A, 3B, 3C, 3D, and 3F were all well platonised at burning rates between 2.3 and 4.3 mm $s^{-1}$. These results show that a ballistic modifier based on copper succinate and lead citrate can advantageously modify the ballistics of a wide range of double base propellants to undergo well platonised combustion at very low burning rates.

EXAMPLE 4

Six double-base propellant compositions (labelled Examples 4A through 4F inclusive), each containing a ballistic modifier consisting of a mixture of copper succinate and lead (II) acetophthalate, were prepared from the following constituents listed in Table 3 below. Excepting Example 4F, each composition was carefully formulated to ensure that CV remained constant at 3400 kJ/kg, and to ensure the level of the burning rate depressant SAO remained constant at 9.8% by weight. Only the copper salt and lead salt content of the composition of Examples 4A to 4E inclusive was significantly varied. Example 4F (CV 3750 kJ/kg) was included as an example of a composition containing lead acetophthalate and copper succinate, where the content of copper succinate was much higher than Examples 4A to 4E.

TABLE 3

| | % by weight | | | | | |
|---|---|---|---|---|---|---|
| Constituent | Ex 4A | Ex 4B | Ex 4C | Ex 4D | Ex 4E | Ex 4F |
| NC (12.6 N) | 43.4 | 42.4 | 40.9 | 42.8 | 41.6 | 48.6 |
| NG | 35.5 | 36.2 | 37.1 | 35.9 | 36.7 | 32.4 |
| TA | 8.4 | 8.4 | 8.2 | 7.7 | 8.5 | 8.0 |
| SOA | 9.8 | 9.8 | 9.8 | 9.8 | 9.7 | — |
| 2-NDPA | 0.3 | 0.3 | 0.3 | 0.3 | 0.3 | 0.3 |
| p-NMA | 1.2 | 1.2 | 1.2 | 1.2 | 1.2 | 0.8 |
| Copper succinate | 0.4 | 0.4 | 0.6 | 0.4 | 0.6 | 2.6 |
| lead acetophthalate | 1.0 | 1.4 | 1.9 | 1.9 | 1.4 | 1.6 |
| RUA | — | — | — | — | — | 5.7 |

Each of the compositions of Table 3, and a further unmodified composition of identical CV to that of Example 4F, were prepared in the same way as the composition of Example 1, and cured changes of these compositions were subjected to ballistic tests in order to determine the relationship between burning rate and combustion chamber pressure for each. The results of ballistic tests conducted on Examples 4A, 4D, 4F and the unmodified composition, are all illustrated graphically in FIG. 3.

FIG. 3 shows that Examples 4A and 4D were both very well platonised at burning rates of 3.0 and 2.8 mm $s^{-1}$ respectively and pressures of 3.9 and 3.2 MPa respectively, and the region of platonisation for both composition extended approximately from 2.5 to 4.0 MPa. Neither Example 4F nor the unmodified composition exhibited any platonisation effects. Of the remaining compositions of Examples 4B, 4C and 4E, all exhibited ballistic properties very similar to those of Examples 4A and 4D.

From these results, it can be concluded that for a wide range of ballistic modifier compositions, a lead acetophthalate/copper succinate modifier may bring about a consistent improvement in the ballistic properties of double base propellants at very low burning rates of 2–4 mm $s^{-1}$. Furthermore, the improvement to ballistic properties appears relatively insensitive to the exact composition of this modifier. However, the copper succinate level must be maintained at a level below 2.6% of the propellant composition to ensure that platonisation occurs at useful chamber pressure above 2 MPa.

EXAMPLE 5

Four double based propellant compositions (labelled Examples 5A through 5D inclusive), each containing a ballistic modifier consisting of a mixture of copper succinate and lead (II) acetophthalate, were prepared from the following constituents listed in Table 4 below. The compositions were carefully formulated such that the CV of each example remained constant, and where possible only the content of the burning rate-depressant SOA was significantly varied.

TABLE 4

| | % by weight | | | |
|---|---|---|---|---|
| Constituent | Ex 5A | Ex 5B | Ex 5C | Ex 5D |
| NC (12.6 N) | 41.8 | 41.4 | 35.1 | 33.2 |
| NG | 37.5 | 37.2 | 41.6 | 43.1 |
| TA | 10.3 | 8.1 | 8.3 | 7.3 |
| SOA | 6.8 | 9.8 | 10.7 | 11.8 |
| 2-NPDA | 0.3 | 0.3 | 0.3 | 0.3 |
| p-NMA | 0.7 | 0.7 | 1.2 | 1.3 |
| copper succinate | 0.6 | 0.6 | 1.0 | 1.1 |

TABLE 4-continued

| Constituent | % by weight | | | |
|---|---|---|---|---|
| | Ex 5A | Ex 5B | Ex 5C | Ex 5D |
| lead acetophthalate | 1.9 | 1.9 | 1.8 | 1.9 |

Each of the compositions of Table 4 were prepared in the same way as the composition of Example 1, and cured charges of these Examples were subjected to ballistic tests in order to determine the relationship between burning rate and combustion chamber pressure for each. The results of ballistic tests conducted on Examples 5A to 5D inclusive are illustrated graphically in FIG. 4.

The ballistic properties of double base propellant compositions modified by the addition of copper succinate and lead acetophthalate were found to be significantly affected by the level of burning rate depressant in the composition. FIG. 4 shows that with increasing rate-depressant content, burning rates generally decreased, platonisation became more pronounced over a wider range of pressures, and both the average pressure and average burning rate at which platonisation occurred decreased. However, at a rate depressant content of 11.7% (Example 5D), platonisation was not produced above a chamber pressure of 2 MPa.

EXAMPLE 6

The four compositions of Example 5A to 5D inclusive were each prepared using two alternative methods of casting powder preparation, which differed substantially from the method used to prepare the casting powder in each of Examples 5A to 5D. In the first alternative method, the same solvents of ethanol and ether were used in the premix and postmix stages respectively for preparing the solid powders, but the premixing time was extended to 3 hours whereas the postmix time was reduced to 15 minutes. In the second alternative method, acetone was used in place of diethyl ether as the gellating solvent in the postmix stage. Ballistic tests were carried out on cured charges of the various compositions.

The results of the tests conducted on the various compositions of Example 6 showed that their ballistic properties were virtually identical to those of the corresponding compositions of Example 5.

EXAMPLE 7

A cast double base propellant composition containing a crystalline nitramine explosive filler (RDX) and a ballistic modifier consisting of copper succinate and lead acetophthalate was prepared from three components. The composition of each component is given in Table 5 below.

TABLE 5

| Powder A Constituent | Component | | |
|---|---|---|---|
| | Casting Powder B (% by weight) | Casting Liquid C (% by weight) | Casting (% by weight) |
| NC | 30.0 | 57.0 | — |
| NG | 19.0 | 24.2 | 63.1 |
| RDX | 50.0 | — | — |
| TA | — | — | 25.8 |
| SOA | — | 9.8 | 10.0 |
| 2-NDPA | 1.0 | 0.4 | 1.1 |
| p-NMA | — | 1.4 | — |
| Copper Succinate | — | 1.8 | — |
| Lead Aceto- | — | 5.4 | — |

TABLE 5-continued

| Powder A Constituent | Component | | |
|---|---|---|---|
| | Casting Powder B (% by weight) | Casting Liquid C (% by weight) | Casting (% by weight) |
| phthalate | | | |

The cast propellant contained the three components in the following proportions by weight: 50% Powder A, 22% Powder B, and 28% Liquid C, giving the cast propellant the following composition:

| Constituent | % by weight |
|---|---|
| NC | 27.4 |
| NG | 32.4 |
| RDX | 25.3 |
| TA | 7.2 |
| SOA | 4.9 |
| 2-NDPA | 0.4 |
| p-NMA | 0.3 |
| Copper Succinate | 0.4 |
| Lead Acetophthalate | 1.2 |

Each of the Casting Powders A and B were prepared by blending the powder constituents together, in the correct proportions, for one hour with ethanol in a premix stage at room temperature. A quantity of diethyl ether was then added, and mixing was continued for three hours in a postmix stage to produce an homogeneous, doughy mass. The mass was then hydraulically pressed and extruded into a 1 mm diameter cord extrudate. This extrudate was cut into 1 mm lengths and dried to a powder for 12 to 15 hours in warm air at 45°–60° C.

Casting Powders A and B were blended together in the correct proportions and packed into a mould. Casting Liquid C was then slowly pumped into the base of the mould, the amount added being just sufficient to fill the interstices. The contents of the mould were then maintained at 45°–60° C. for 4–6 days to produce a cured charge of the propellant composition of Example 7. A number of identical charges were prepared by the above method, so that the ballistic properties of the propellant composition could be determined at a number of combustion chamber pressures. A logarithmic graphical representation of the ballistic properties of these charges is illustrated in FIG. 5.

FIG. 5 shows that the cast propellant composition of Example 7 exhibits platonised ballistics at a burning rate of about 3.5 mm $s^{-1}$ over a combustion chamber pressure range of 2–4 MPa.

EXAMPLES 8–10

In the following Examples, extruded double base propellant compositions were prepared by the following method. All the ingredients of each composition except the ballistic modifier were first mixed under water to produce a slurry. The slurry was then dewatered to about 50% water content, and the ballistic modifier was incorporated by mixing into the resulting paste. The incorporated paste was then dried to a moisture level of less than 1% and then gelatinised by passing through even speed rolls at about 50° C. The gap between the rolls (W) and the number of times the dried paste was past between the rolls (N) were selected to ensure development of the desired plateau/mesa ballistics. The rolling gap (W) was increased in steps to accommodate the gradually swelling propellant. The resulting gelatinised propellant sheet was fabricated into propellant charges by extrusion techniques well known to those skilled in the double base propellant art.

EXAMPLE 8

Three extruded double base propellant compositions (labelled Examples 8A, 8B and 8C), each containing a ballistic modifier consisting of a mixture of a lead salt and copper succinate, were prepared from the following constituents listed in Table 6 below. In Table 6 are also given the rolling conditions used to prepare the propellant sheet, and the CV's of the final compositions.

TABLE 6

| | Example 8A | Example 8B | Example 8C |
|---|---|---|---|
| Constituent (% by weight) | | | |
| NC | 55.5 | 52.0 | 53.5 |
| NG | 30.2 | 31.4 | 35.5 |
| TA | 9.7 | — | 6.0 |
| *DBP | — | 12.6 | — |
| 2-NDPA | 1.9 | — | 1.5 |
| Carbamite | — | 2.0 | — |
| Candelilla Wax | 0.075 | 0.075 | 0.075 |
| Copper Succinate | 2.0 | 1.0 | 0.5 |
| Lead Stannate | 0.7 | — | — |
| White Lead | — | 1.0 | — |
| Lead phthalate | — | — | 3.0 |
| Rolling Gap (W) mm | 1 2 2.5 | 1 2 2.5 | 1 2 2.5 |
| Number of passes (N) | 30 5 4 | 15 5 4 | 30 5 4 |
| CV, kJ/kg | 3680 | 3140 | 3140 |

*DEP = dibutyl phthalate

The results of ballistic tests conducted on Example 8A and 8B are illustrated graphically in FIG. 6, and the results of ballistic tests conducted on Example 8C are illustrated graphically in FIG. 7.

FIGS. 6 and 7 show that Examples 8A, 8B, and 8C exhibit well developed platonisation at useful chamber pressures above 2 MPa and in the burning rate of 4 to 10 mm $s^{-1}$.

EXAMPLE 9

Three extruded double base propellant compositions (labelled Examples 9A, 9B, and 9C), each containing a ballistic modifier consisting of a mixture of a lead salt and copper oxalate, were prepared from the following constituents list in Table 7 below. In Table 7 are also given the rolling conditions used to prepare the propellant sheet, and the CV's of the final compositions.

TABLE 7

| | Example 9A | Example 9B | Example 9C |
|---|---|---|---|
| Constituent (% by weight) | | | |
| NC | 55.5 | 52.0 | 53.5 |
| NG | 30.2 | 31.4 | 35.5 |
| TA | 9.7 | — | 6.0 |
| DBP | — | 12.6 | — |
| 2-NDPA | 1.9 | — | 1.5 |
| Carbamite | — | 2.0 | — |
| Candellilla wax | 0.075 | 0.075 | 0.075 |
| Copper oxalate | 2.0 | 1.0 | 0.5 |
| Lead stannate | 0.7 | — | — |
| White lead | — | 1.0 | — |
| Lead phthalate | — | — | 3.0 |
| Rolling gap (W) mm | 1 2 2.5 | 1 2 2.5 | 1 2 2.5 |
| Number of passes (N) | 30 5 4 | 15 5 4 | 30 5 4 |
| CV, kJ/kg | 3680 | 3140 | 3140 |

The results of ballistic test conducted on Examples 9A and 9B are illustrated graphically in FIG. 8, and the result of ballistic tests conducted on Example 9C are illustrated graphically in FIG. 9.

FIGS. 8 and 9 show that Examples 8A, 8B and 8C exhibit well developed platonisation at useful chamber pressures above 2 MPa and in the burning rate range 5 to 20 mm $s^{-1}$.

EXAMPLE 10

Two extruded double base propellant compositions (labelled Examples 10A and 10B), each containing a ballistic modifier consisting of a lead salt and copper tartrate, were prepared from the following constituents listed in Table 8 below. In Table 8 are also given the rolling conditions used to prepare the propellant sheet, and the CV's of the final compositions.

TABLE 8

| | Example 10A | Example 10B |
|---|---|---|
| Constituents (% by weight) | | |
| NC | 55.5 | 52.0 |
| NG | 30.2 | 31.4 |
| TA | 9.7 | — |
| DBP | — | 12.6 |
| 2-NDPA | 1.9 | — |
| Carbamite | — | 2.0 |
| Candelilla wax | 0.075 | 0.075 |
| Copper tartrate | 2.0 | 1.0 |
| Lead stannate | 0.7 | — |
| White lead | — | 1.0 |
| Rolling gap (W), mm | 1 2 2.5 | 1 2 2.5 |
| Number of passes (N) | 30 5 4 | 15 5 4 |
| CV, kJ/kg | 3680 | 3140 |

The results of ballistic tests conducted on Examples 10A and 10B are illustrated graphically in FIG. 10.

FIG. 10 shows that Examples 10A and 10B exhibit well developed platonisation at useful combustion chamber pressures above 2 MPa and in the burning rate range of 5 to 9 mm $s^{-1}$.

I claim:

1. A double base propellant composition comprising nitrocellulose, nitroglycerine and a ballistic modifier, said modifier comprising at least one lead compound and at least one copper (II) salt of an aliphatic dicarboxylic acid.

2. A propellant composition according to claim 1 wherein the at least one copper salt comprises copper succinate.

3. A propellant composition according to claim 1, wherein the at least one lead compound comprises a lead (II) salt of an inorganic acid.

4. A propellant composition according to claim 3 wherein the lead salt of an inorganic acid is selected from the group consisting of basic lead carbonate and lead stannate.

5. A propellant composition according to claim 1 wherein the at least one lead compound comprises a lead (II) salt of an organic acid.

6. A propellant composition according to claim 5 wherein the lead salts of an inorganic acid is selected from the group consisting of lead citrate, lead phthalate and lead acetophthalate.

7. A propellant composition according to claim 1 wherein the ratio (by weight) of lead compounds to copper salts of aliphatic dicarboxylic acids in the ballistic modifier is between 1:4 and 1:0.1.

8. A propellant composition according to claim 1 wherein the composition contains 0.2% to 3.0% (by weight) of the at least one copper salt of an aliphatic dicarboxylic acid.

9. A propellant composition according to claim 1 wherein the composition contains from 1% to 6% (by weight) of the ballistic modifier.

10. A propellant composition according to claim 1 wherein the composition contains between 0% and 15% (by weight) of a burning rate depressant.

11. A propellant composition according to claim 10 wherein the burning rate depressant is selected from the group consisting of sucrose octa-acetate and raffinose undeca-acetate.

12. A propellant composition according to claim 1 having a calorimetric value of less than 4,200 kJ/kg.

13. A propellant composition according to claim 1 wherein the composition additionally comprises between 0% and 30% (by weight) of a crystalline nitramine explosive filler.

14. A propellant composition according to claim 13 wherein the nitramine explosive filler comprises cyoclotrimethylenetrinitamine.

15. A casting powder suitable for use in the manufacture of a double base propellant composition, said powder comprising nitrocellulose, nitroglycerine, and a ballistic modifier, and said modifier comprising at least one lead compound and at least copper (II) salt of an aliphatic dicarboxylic acid.

16. A casting powder according to claim 15 wherein the at least one copper salt of an aliphatic dicarboxylic acid comprises copper succinate.

17. A casting powder according to claim 15 wherein the powder contains from 0.3% to 4.5% (by weight) of the at least one copper salt of an aliphatic dicarboxylic acid.

18. A casting powder according to claim 15, wherein the powder contains from 1.5% to 9.0% (by weight) of the ballistic modifier.

* * * * *